US007564417B2

(12) United States Patent
Tengler et al.

(10) Patent No.: US 7,564,417 B2
(45) Date of Patent: Jul. 21, 2009

(54) ANTENNA DEVICE HAVING A NON-ELECTRICAL ENGAGEMENT DURING PRE-LOCK

(75) Inventors: David Richard Tengler, West Bloomfield, MI (US); Qing Li, Novi, MI (US); Kendra Diane Manduzzi, Whitmore Lake, MI (US); Jack Huling, Whittaker, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 129 days.

(21) Appl. No.: 11/742,902

(22) Filed: May 1, 2007

(65) Prior Publication Data

US 2008/0272969 A1 Nov. 6, 2008

(51) Int. Cl.
*H01Q 1/32* (2006.01)

(52) U.S. Cl. ..... 343/715; 343/713; 343/906; 439/374

(58) Field of Classification Search ..... 343/713, 343/715, 906, 711; 439/374, 559
See application file for complete search history.

(56) References Cited

U.S. PATENT DOCUMENTS

| | | | | |
|---|---|---|---|---|
| 4,302,760 | A | 11/1981 | Laufer | |
| 6,078,300 | A | 6/2000 | Militz et al. | |
| 6,236,377 | B1 | 5/2001 | Hussaini et al. | |
| 6,331,838 | B1 | 12/2001 | Scott et al. | |
| 6,469,678 | B1 | 10/2002 | Pullen | |
| 6,486,841 | B1 | 11/2002 | Imahigashi | |
| 6,714,171 | B2 * | 3/2004 | Haussler et al. | 343/888 |
| 6,762,727 | B2 | 7/2004 | Rochford et al. | |
| 7,004,666 | B2 * | 2/2006 | Kozlovski | 403/252 |
| 7,088,297 | B2 * | 8/2006 | Nakano et al. | 343/713 |
| 7,215,291 | B2 * | 5/2007 | Nakano et al. | 343/715 |
| 7,336,231 | B2 * | 2/2008 | Hayashi et al. | 343/713 |
| 7,429,958 | B2 * | 9/2008 | Lindackers et al. | 343/713 |
| 2004/0183734 | A1 | 9/2004 | Noro | |
| 2006/0077112 | A1 | 4/2006 | Nakano et al. | |

FOREIGN PATENT DOCUMENTS

| | | |
|---|---|---|
| JP | 10022718 | 1/1998 |

* cited by examiner

*Primary Examiner*—Tho G Phan
(74) *Attorney, Agent, or Firm*—Frank A. MacKenzie; Brooks Kushman P.C.

(57) ABSTRACT

An antenna device has an antenna main body, a fixing member and a bolt. The antenna main body comprises an antenna element, female connectors provided at a first connector, a female screw section, and an engagement claw inserted into an antenna mount hole to make engagement with a lower side face of a roof panel. A fixing member comprises cables, male connectors provided at a second connector, the male connectors being provided to make mechanical engagement with female connectors without an electrical connection, and being connected to the cable, and a male screw section helically fitted to a female screw section, thereby tightening the female connectors, the male connectors, and a roof panel with one another. A bolt may be mounted between the male and female connectors to allow electrical connection therebetween.

13 Claims, 9 Drawing Sheets

ANTENNA DEVICE HAVING A NON-ELECTRICAL ENGAGEMENT DURING PRE-LOCK

BACKGROUND OF THE INVENTION

1. Field of the Invention

The multiple embodiments of present invention relate to an antenna device mounted on a vehicle body such as an automobile.

2. Background Art

Conventionally, a variety of antenna devices may be mounted on a vehicle body of an automobile. FIGS. 14 and 15 are views each showing an example of such an antenna device. As depicted, an antenna device 1 is composed of: an antenna main body 2 provided at an upper side of a roof panel R; and a mount nut 10 provided at a lower side of the roof panel R. The antenna main body 2 comprises: an antenna cover 3; an antenna element 4 mounted on the antenna cover 3; a pad section 5 disposed between the antenna cover 3 and the roof panel R; and a base section (not shown) and a substrate 6 provided at the pad section 5. A matching circuit or an amplifier circuit and a duplexer are incorporated in the substrate 6.

A protrusion section 7 is provided on a lower face of the base section as shown in FIG. 15, and is inserted into an antenna mount hole. A through hole is formed at the inside of the protrusion section 7, and an AM/FM coaxial cable 8 for transmitting a signal and a power supply line 9 for supplying power to the substrate 6 are drawn via the through hole.

The mount nut 10 comprises a ground washer 11 and a nut section 12, and the ground washer 11 is assembled to be rotatable with respect to the nut section 12.

In such an antenna device 1, the antenna main body 2 is first mounted on the antenna mount hole of the roof panel R from overhead shown in FIG. 15. At this time, the antenna main body 2 is temporarily locked so as to be immobilized by a temporarily locking claw 7*b* or the like. Next, the coaxial cable 8 and the power supply line 9 are routed into a through hole of the protrusion section 7 of the pad section 5. Then, the nut section 12 of the mount nut 10 is helically fitted to the screw section 7*a* formed on an outer periphery face of the protrusion section 7. Further, when the nut section 12 is rotated, a triangle shaped distal end of the ground washer 11 is cut into a lower face side of the roof panel R shown in FIG. 15, and the antenna main body 2 is securely fixed to the roof panel R and is grounded.

Typically, when an antenna base is snapped onto the main body of a vehicle, the antenna base appears to be fully installed, but the bolt or nut has not been driven to provide full compression between the antenna base and the vehicle body, sealing between the antenna base and the vehicle body and grounding of the antenna to the vehicle body. The undesired result of having the bolt or nut not driven while appearing to be fully installed is that a vehicle can be shipped to a customer with the potential for water leakage through the antenna mounting hole. Many times, electrical connections are established through pigtails or a connector which allow for electrical connection when the antenna is partially mated the vehicle body allowing the antenna to electrically function, but the compression and seal have not occurred.

SUMMARY OF THE INVENTION

At least one embodiment of the present invention discloses an antenna device having an antenna main body, a fixing member and a bolt. An antenna main body connectable to a first face side of a plate having a mount hole provided therein, the antenna main body including an antenna element, a first connector electrically connected to the antenna element, a first screw section passing through the mount hole, and an engagement section inserted into the mount hole. A fixing member disposed on a second face side of the plate configurable to removable secured the antenna main body to the plate having a feeder line provided to make connection with the antenna element, a second connector having a male connector removably received by a female connector of the first connector and a second screw section securable to the first screw section to join the antenna main body, the fixing member, and the plate adjacent each other.

A bolt received within a cylinder body for assembling the antenna main body and fixing member. A mechanical engagement and a temporary lock are achieved when the male connector has been inserted a predetermined distance in the female connector and electrical connection between the male and female connectors is not achieved, and fastening of the bolt joins the first and second screw sections to allow an electrical connection between the male and female connectors.

In at least another embodiment of the present invention, an antenna device adapted to be mounted on a roof of a vehicle is disclosed. An antenna main body connectable to a first face side of a plate having a mount hole provided therein, the antenna main body including an antenna element, a first connector electrically connected to the antenna element, a first screw section passing through the mount hole, and an engagement section inserted into the mount hole. A fixing member disposed on a second face side of the plate configurable to removable secured the antenna main body to the plate having a feeder line provided to make connection with the antenna element, a second connector having a male connector removably received by a female connector of the first connector and a second screw section securable to the first screw section to join the antenna main body, the fixing member, and the plate adjacent each other.

A bolt received within a cylinder body and mounting hole in the vehicle roof for securing the antenna device to the vehicle roof. A mechanical engagement and a temporary lock are achieved when the male connector has been inserted a predetermined distance in the female connector and electrical connection between the male and female connectors is not achieved, and fastening of the bolt joins the first and second screw sections to allow an electrical connection between the male and female connectors.

DETAILED DESCRIPTION OF EMBODIMENTS OF THE INVENTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for the claims and/or as a representative basis for teaching one skilled in the art to variously employ the present invention.

Figure 1:
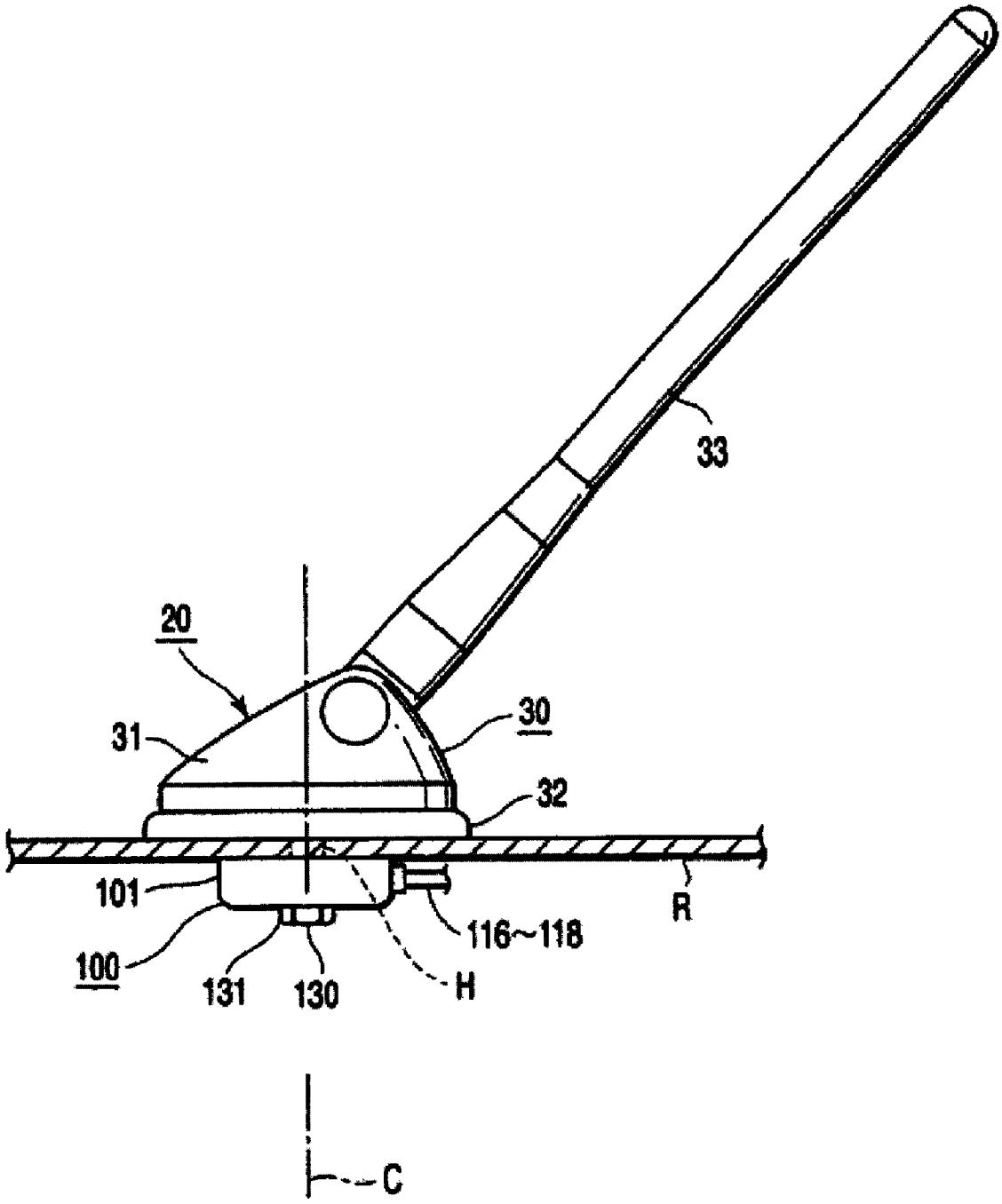
FIG. 1 is a side view showing an antenna device according to a first embodiment of the present invention.
Figure 2:
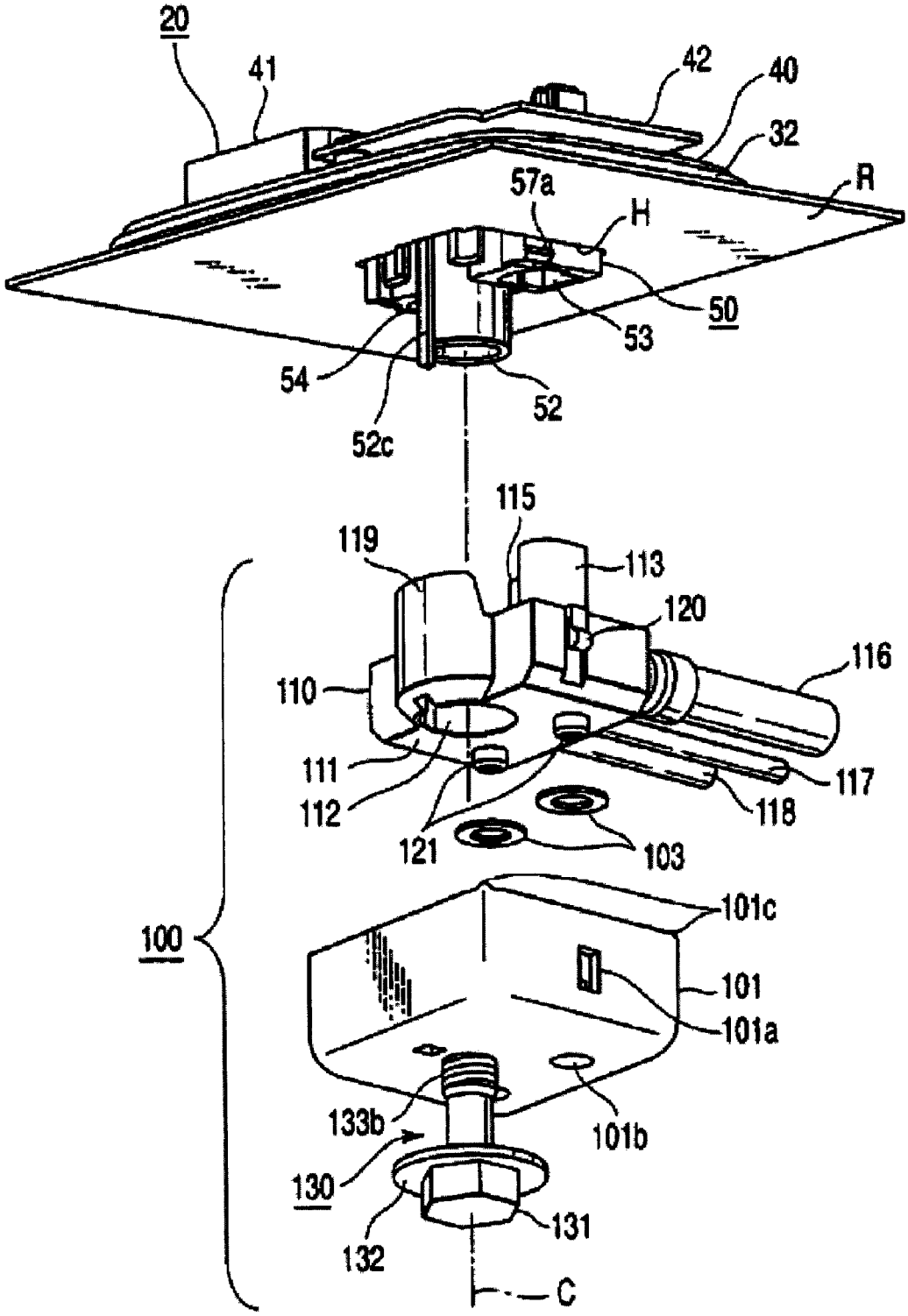
FIG. 2 is an exploded perspective view showing the antenna device from the lower side.
Figure 3:
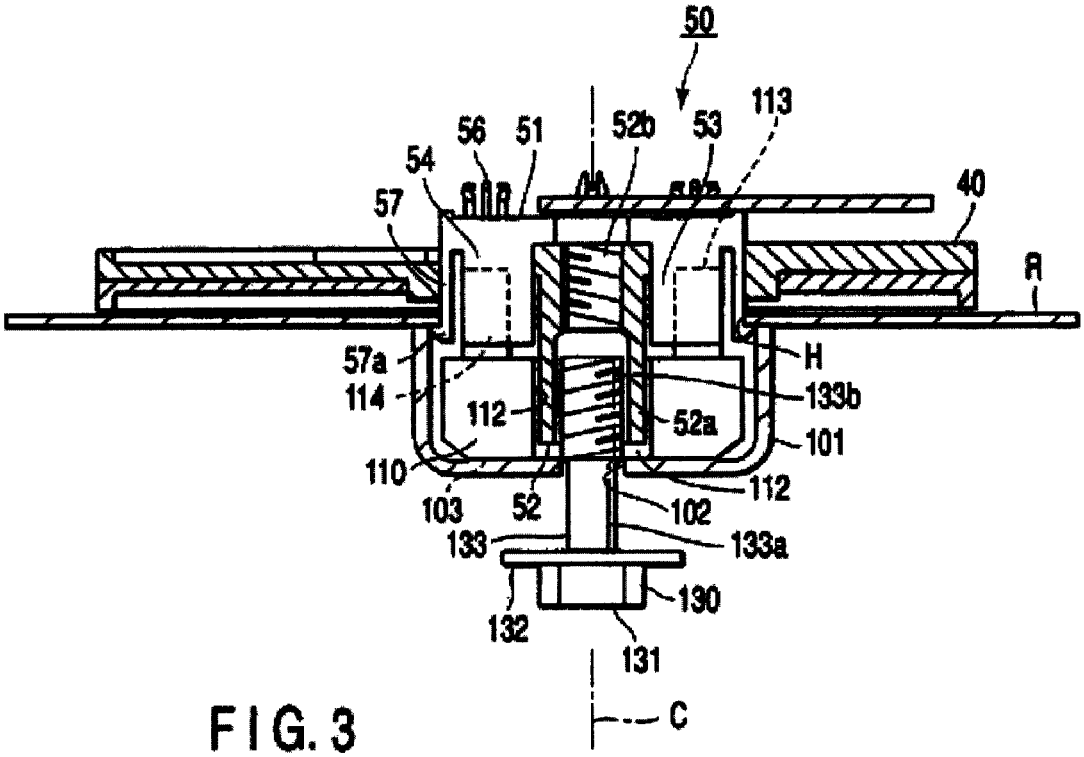
FIG. 3 is a longitudinal cross section showing the antenna device.
Figure 4:
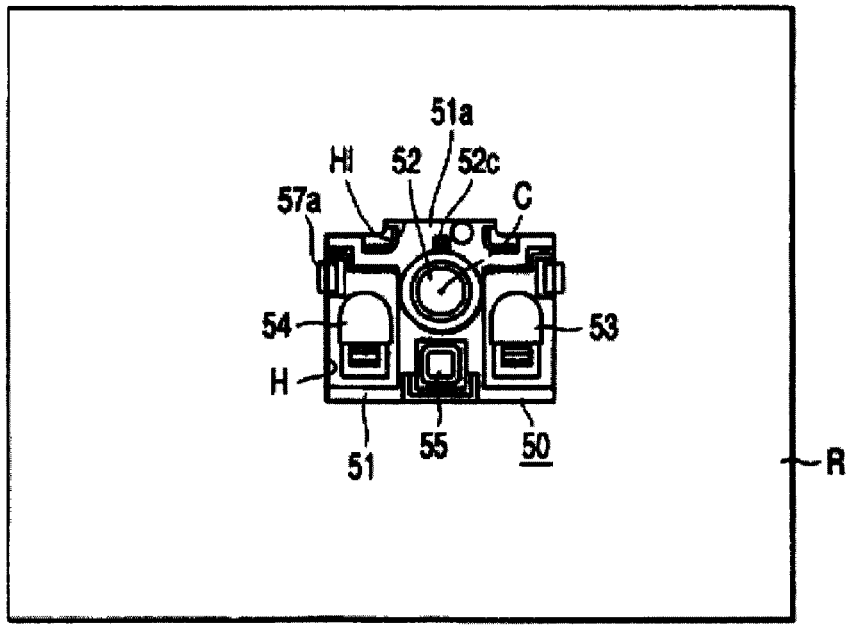
FIG. 4 is a plan view showing an antenna main body of the embodiment from a lower side when the main body is inserted into a roof panel.
Figure 5:
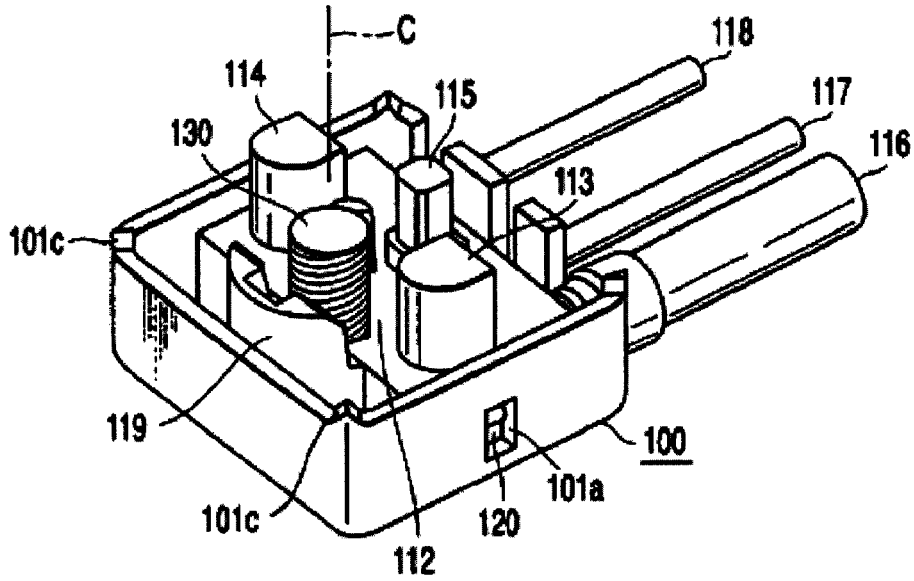
FIG. 5 is a perspective view showing a fixing member of the embodiment.
Figure 6:
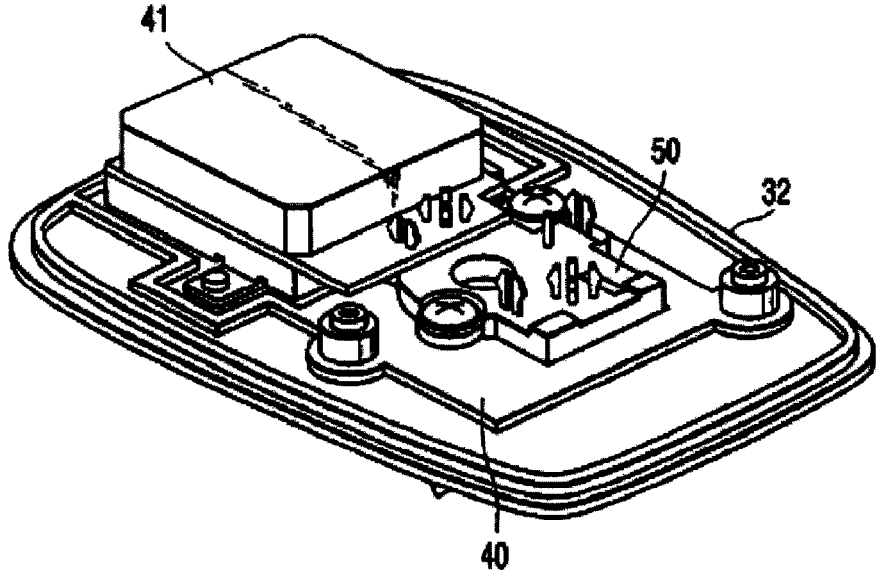
FIG. 6 is a perspective view showing a process of assembling the antenna main body.
Figure 7:
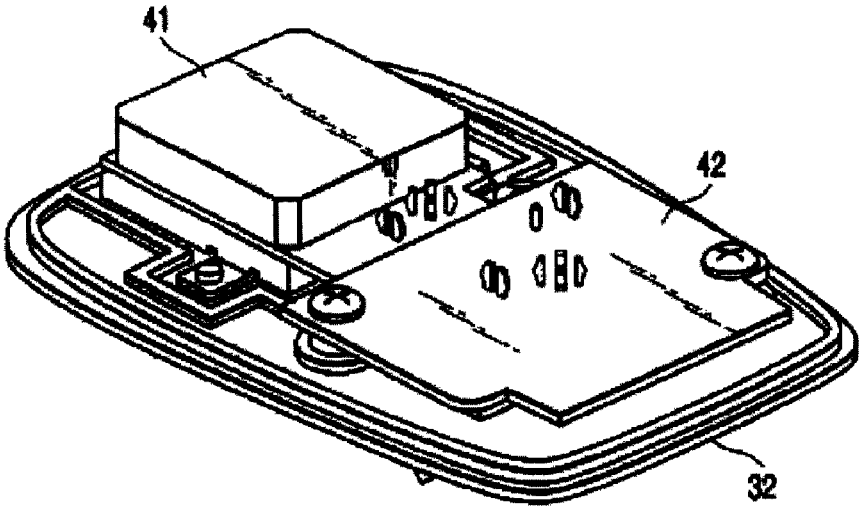
FIG. 7 is a perspective view showing a process of assembling the antenna main body.
Figure 8:
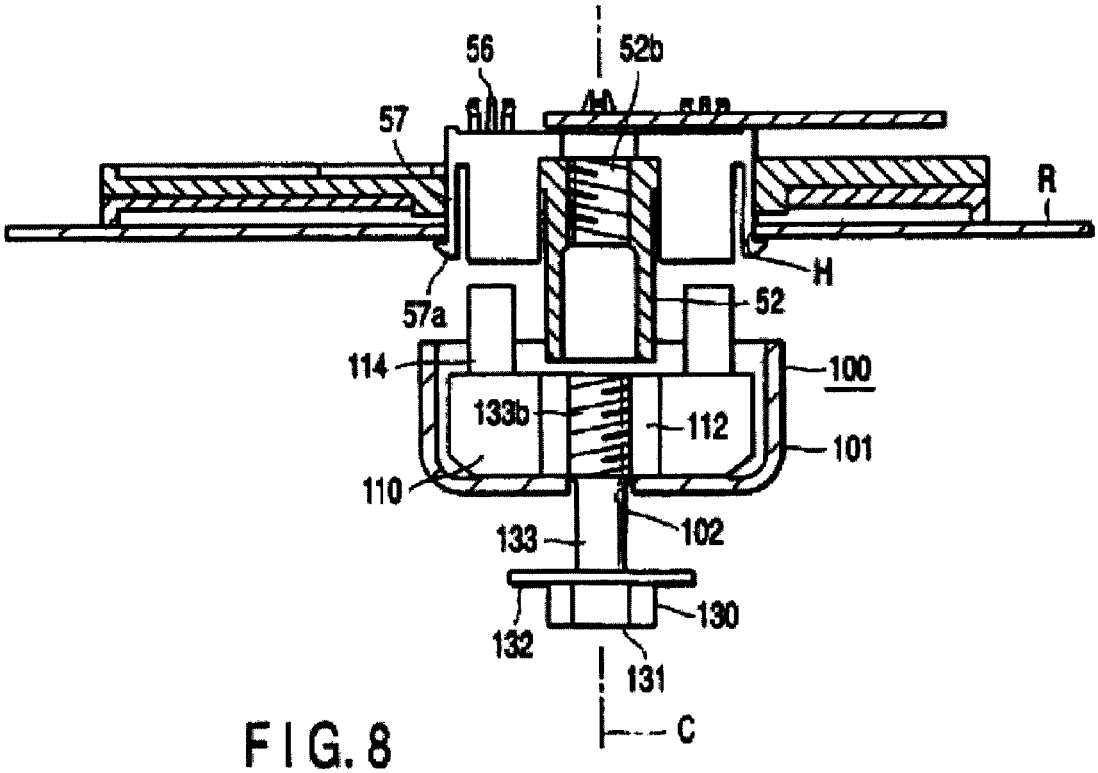
FIG. 8 is a longitudinal section view showing a process of assembling the antenna device.
Figure 9:
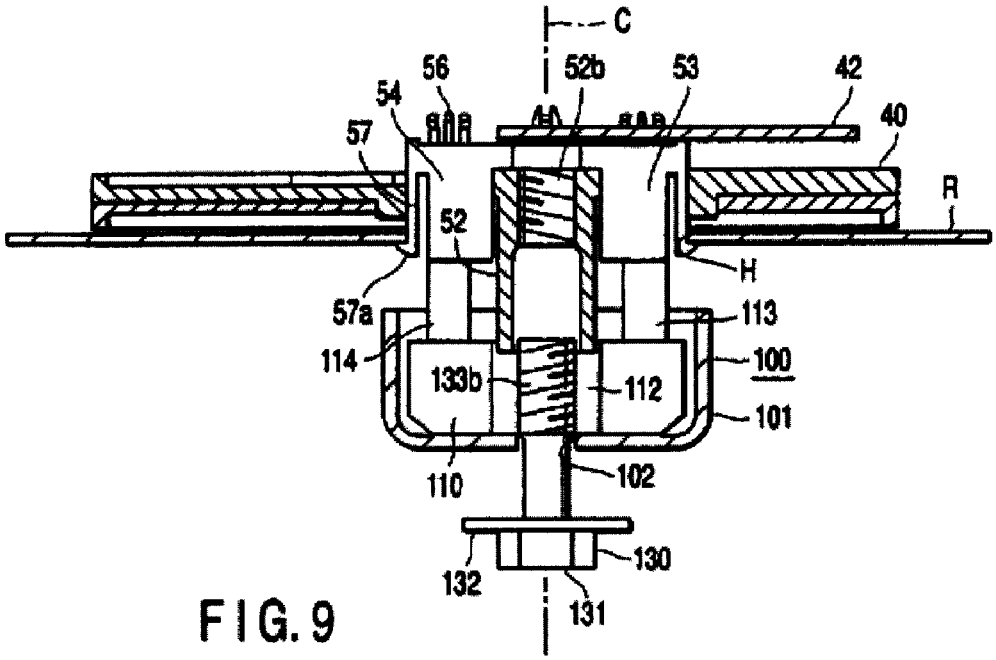
FIG. 9 is a longitudinal section view showing a process of assembling the antenna device.
Figure 10:
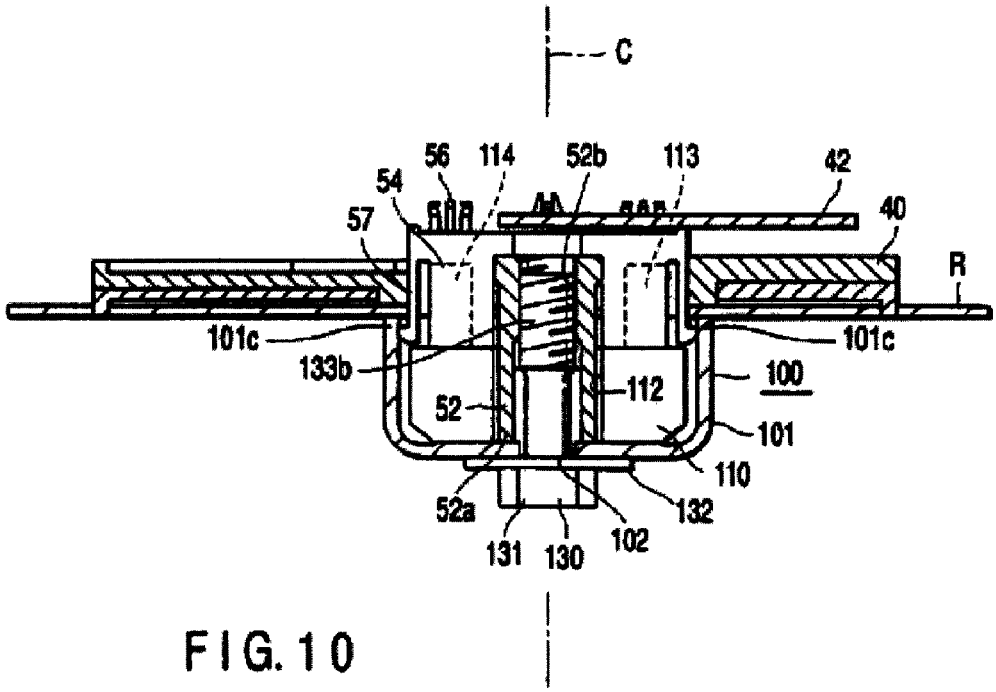
FIG. 10 is a longitudinal section view showing a process of assembling the antenna device.

FIG. 1 is a side view showing an antenna device 20 according to a first embodiment of the present invention; FIG. 2 is an exploded perspective view showing the antenna device 20 from the lower side; FIG. 3 is a longitudinal cross section showing the antenna device 20; FIG. 4 is a plan view showing an antenna main body 30 from a lower side when the main body is inserted into a roof panel R; FIG. 5 is a perspective view showing a fixing member 100; FIGS. 6 and 7 are perspective views showing a process of assembling the antenna main body 30; and FIGS. 8 to 10 are longitudinal section views showing a process of assembling the antenna device 20. C in these figures indicates a tightening direction in which a screw is mounted by tightening a bolt 130 described later. In addition, R in these figures indicates a roof panel which configures a vehicle body such as an automobile, and H indicates an antenna mount hole. The antenna mount hole H is formed in a substantially rectangular shape, and a cutout H1 is partly formed.

The antenna device 20 comprises the antenna main body 30 and the fixing member 100 as shown in FIG. 1. The antenna main body 30 comprises an antenna cover 31 and a pad 32 pinched between the antenna cover 31 and the roof panel R. An AM/FM antenna element 33 is mounted on the antenna cover 31.

A base 40 is mounted on the pad 32 as shown in FIG. 6. A patch antenna 41, a substrate 42, and a first connector 50 are mounted on the base 40.

The first connector 50, as shown in FIG. 3, has a rectangular plate shaped connector main body 51; a cylinder body 52 provided at a center part of a lower face side of the connector main body 51 shown in FIG. 3; three female connectors 53 to 55 disposed at the periphery of the cylinder body 52 in parallel to an axial direction of the cylinder body 52; a terminal 56 provided at an upper face side of the connector main body 51 shown in FIG. 3, and connected to the female connectors 53 to 55; and a spring plate 57 erected from a side face of the connector main body 51. A protrusion section 51*a* matching the cutout H1 is formed on the side face of the connector main body 51.

The cylinder body 2 has two types of internal diameters, and comprises an inner cylinder section 52*a* having a slightly larger diameter and a female screw section 52*b* having a slightly small diameter in which a female screw has been formed on its inner face. On an outer periphery face of the cylinder body 52, a protrusion stripe section 52*c* is formed along an axial direction of the cylinder body 52.

The spring plate 57 is formed so as to be slackened in a transverse direction shown in FIG. 3 while the engagement claw 57*a* is formed at a distal end of the sprint plate. The engagement claw 57*a* is formed so as to engage with a peripheral edge at the vehicle inside (lower face in FIG. 3) of the antenna mount hole H of the roof panel R.

The fixing member 100, as shown in FIG. 2, comprises: a bottomed cylinder shaped cover body (grounding member) 101 made of an electrically conductive material, for example, stainless or nickel plated iron; a second connector 110; and a bolt 130. In addition, a through hole 102 is formed at the cover body 101, the through hole having formed therein a female screw helically fitted by a male screw section 133*b* of the bolt 130 described later. In addition, a wave washer (elastic body) 103 is disposed in a gap between the cover body 101 and the second connector 110 and biases the second connector 110 upwardly.

An engagement hole 101*a*, a positioning hole 101*b*, and a protrusion section 101*c* are formed on the cover body 101. The engagement hole 101*a* restricts a movement other than a tightening direction of an engagement claw 120 described later by engaging it with the engagement claw 120. The positioning hole 101*b* positions the cover body 101 and the second connector 110 due to a protrusion section 121 described later being inserted thereinto. The protrusion section 101*c* abuts against the roof panel R.

The engagement claw 120 is configured to engage the cover body 101 and the second connector 110 with each other and to prevent the second connector 110 from being connected to the first connector 50 by a predetermined force or more at the time of bolt tightening. Therefore, a length in the tightening direction of the engagement hole 101*a* is defined such that the second connector 110 is connected to the first connector 50 at a desired position based on a relationship with a biasing force of the wave washer 103 at the time of tightening of the bolt 130.

The second connector 110, as shown in FIG. 3, has a rectangular prism shaped connector main body 111; a through hole 112 provided at a center part of the connector main body 111, the above-described cylinder body 52 being inserted into the through hole; male connectors 113 to 115 disposed at the periphery of the through hole 112, and provided to be connected to the above-described female connectors 113 to 115; a guide section 119 provided in parallel to the through hole 112; and an engagement claw 120 provided on a side face of the connector main body 111. In addition, reference numeral 121 shown in FIG. 2 denotes a protrusion section which restricts movement of the wave washer 103.

The cylinder body 52 is provided so as to be freely inserted by the through hole 112 and the guide section 119 and is formed such that rotation in an axial direction of the cylinder body 52 is restricted by a protrusion stripe section 52*c*.

The bolt 130 has a nut 131, a washer 132 integrated with the nut 131, and a shaft body 133. The shaft body 133 has a shaft body section 133*a* having a slightly smaller diameter provided at the side of the nut 131 and a male screw section 133*b* having a slightly larger diameter provided at a distal end side. The male screw section 133*b* is provided so as to be helically fitted to the female screw 52*b* of the cylinder body 52.

The thus configured antenna device 20 may be assembled as follows. The antenna main body 30 and the fixing member 100 are assembled in advance. The antenna main body 30 mounts the patch antenna 41 for high frequency bandwidth on the first connector 50 as shown in FIG. 6. Further, as shown in FIG. 7, the substrate 42 is mounted. From a terminal of the substrate 42, connection to an antenna element 33 is made via a lead wire (not shown), and the antenna cover 31 is mounted. In addition, the fixing member 100 inserts the bolt 130 in advance into the through hole 102 of the cover body 101 as shown in FIG. 8. At this time, a female screw is formed in the through hole 102. Thus, the male screw section 133*b* of the bolt 130 is threaded, thereby preventing the bolt 130 from slipping off from the cover body 101.

The subsequent assembling process may be roughly divided into three steps. That is, a first step is a step of temporarily locking the antenna main body 30. A second step is a step of temporarily locking the fixing member 100 without an electrical connection of the first and second connectors or male and female connectors. A third step is a step of tightening the bolt 130 to allow for electrical connection between the first and second connectors. Each of these steps will be described below.

In the first step, the pad 32 is positioned at the periphery of the antenna mount hole H on the roof panel R and the first connector 50 is inserted into the antenna mount hole H. At this time, the spring plate 57 is bent inwardly by an edge part of the antenna mount hole H before passing through the antenna mount hole H, and then, passes through the mount hole H. Then, the spring plate returns to its original shape and protrudes from the antenna mount hole H, so that the engagement claw 57*a* engages with a back face of the roof panel R and the first connector 50 is temporarily locked with the roof panel R. This state is shown in FIGS. 2 and 3.

When the first connector 50 is inserted into the antenna mount hole H, the connector is mounted such that the protrusion section 51*a* coincides with the cutout H1 in order to prevent incorrect orientation.

In the second step, as shown in FIG. 9, the male connectors 113 to 115 of the second connector 110 are inserted into the female connectors 53 to 55. Mechanical engagement and temporary tightening are achieved at a time point when the male connectors 113 to 115 have been inserted to a predetermined depth of the female connectors 53 to 55. At this time, an electrical connection is not achieved and is not desired because full compression between the antenna device 20 and roof panel R has not been established, a seal between the antenna device 20 and roof panel R has not been established and grounding of the antenna device 20 and roof panel R has not been established.

To establish an electrical connection and be able to electrically test if the antenna device 20 has an electrical connection, the third step is performed. In the third step, as shown in FIG. 10, the male section 133*b* reaches the female screw section 52*b* of the cylinder body 52 when the bolt 130 is mounted. Then, the male section is helically fitted and tightened. The tightening of the bolt 130 is stopped at a time point when the washer 132 is compressed against the cover body 101 by a proper force. The protrusion section 101*c* of the cover body 101 cuts into the roof panel R, whereby full compression between the antenna device 20 and roof panel R is achieved, a seal between the antenna device 20 and roof panel R is achieved, electrical connections are achieved through the connectors 113 to 115 and connectors 53 to 55 and grounding of the antenna device 20 and roof panel R is achieved.

According to the thus configured antenna device 20, a first temporary lock is carried out by inserting the first connector 50 into the antenna mount hole H (first step); a second temporary lock is carried out by inserting the second connector 110 into the first connector 50 without an electrical connection (second step); and lastly, fixing and grounding are carried out by tightening the bolt 130 (third step). Accordingly, the antenna device 20 can be mounted on the antenna mount hole H of the roof panel R with a simplified work, and it becomes possible to reliably provide an electrical test of the antenna device 20 to establish if an electrical connection is established and thus establishing that the antenna device 20 has full compression, a tight seal, and grounding to the roof panel R.

In addition, the second connector 110 can make connection between the male connectors 113 to 115 and the female connectors 53 to 55 each with respect to the cover body 101 in a predetermined design scope by means of working the engagement claw 120 and the engagement hole 101*a*.

Since the second connector 110 has a floating structure along the tightening direction C with respect to the cover body 101, and the wave washer 103 is arranged between the connector and the cover body 101, the second connector 110 is biased to the side of the first connector 50 by the cover body 101 with a proper force. Therefore, the male connectors 113 and the female connectors 53 to 55 are always connected to each other in a proper range, so that a contact state is properly maintained. That is, in a signal having a high frequency bandwidth, there is a case where the signal is not properly transmitted due to a slight shift in the contact state. However, the male connectors 113 to 115 are engaged with the female connectors 53 to 55 with a proper force, as described above, thus making it possible to prevent a loss in connection portion.

As described above, according to the antenna device 20 of the first embodiment, the antenna main body 30 may be assembled in accordance with the simplified procedures. Moreover, the antenna element 33, the pad antenna 41, and the cables 116 to 118 are reliably connected to one another, making it possible to reliably provide grounding.

The biasing means may be made of another material instead of elastic material. For example, it may be a small strip that projects slantwise to a position where the first connector 50 contacts the second connector 110. The strip can work as a blade spring.

By eliminating the wave washer 103 (elastic body), a similar function, for example, a function of setting the second connector 110 to be connected to the first connector 50 at a desired position may be provided at the side of the first connector 50.

Figure 11:
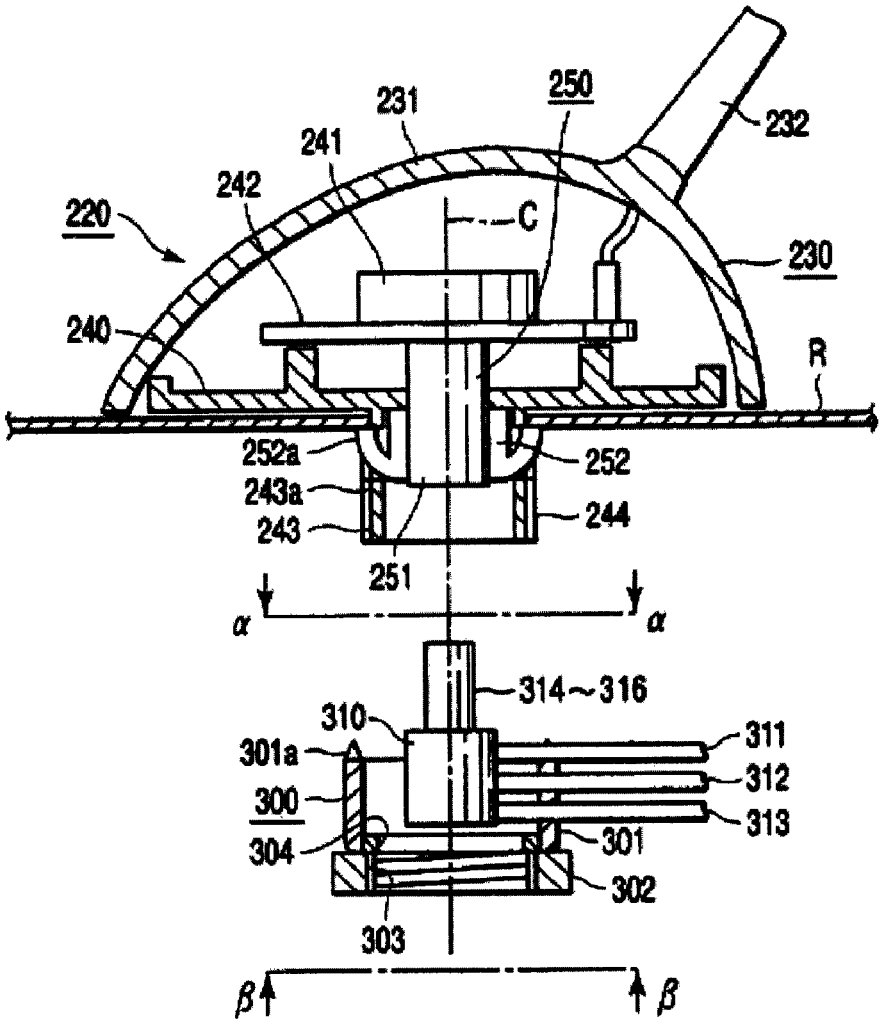
FIG. 11 is a longitudinal cross section showing an antenna device according to a second embodiment of the present invention in an exploded manner.
Figure 12:
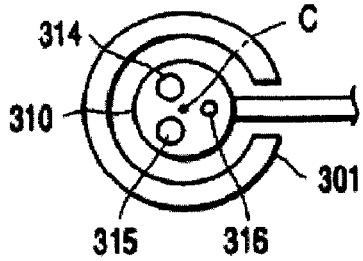
FIG. 12 is a plan view when the antenna device is seen in the direction indicated by the arrow in double dot and chain line α shown in FIG. 11.
Figure 13:
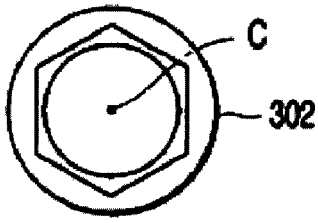
FIG. 13 is a plan view when the antenna device is seen in the direction indicated by the arrow in double dot and chain line β shown in FIG. 11.
Figure 14:
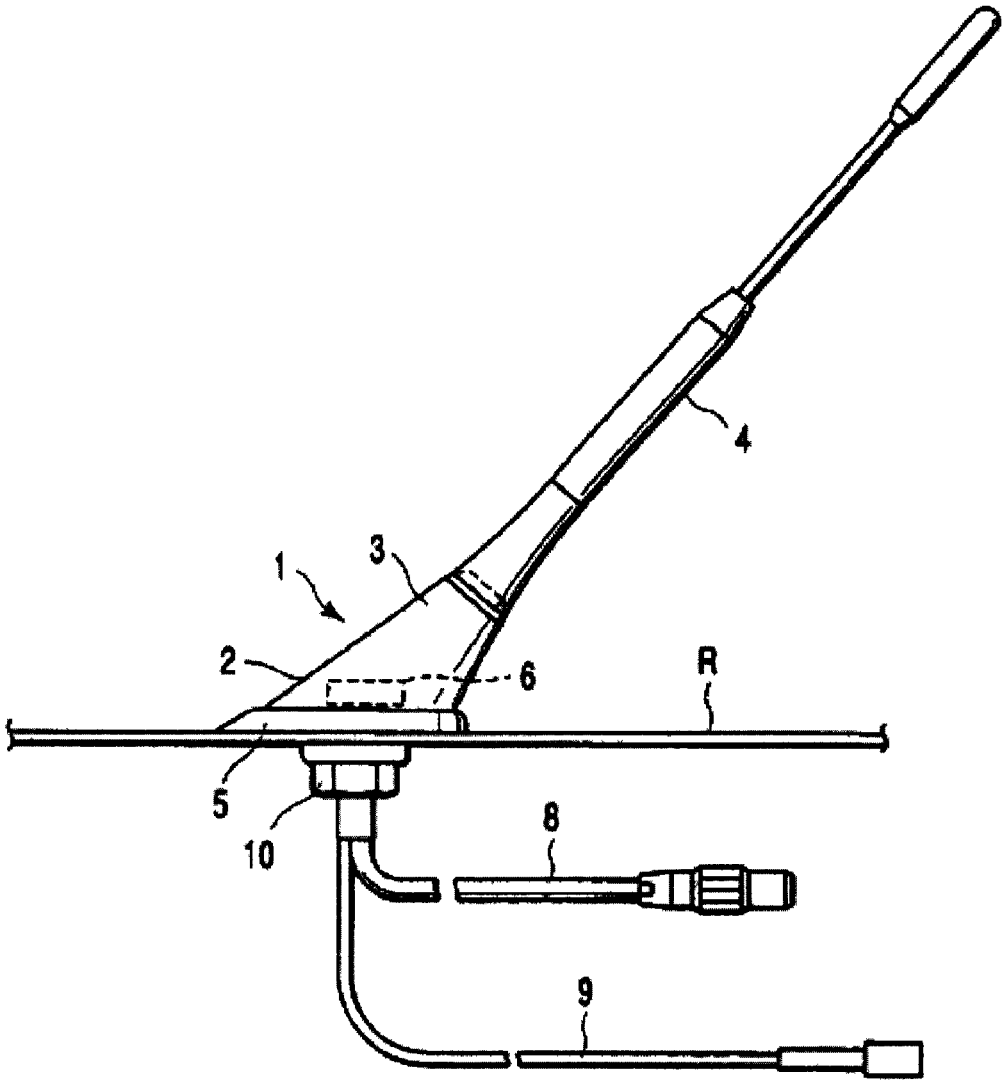
FIG. 14 PRIOR ART
FIG. 14 is a side view showing a conventional antenna device for use in an automobile.
Figure 15:
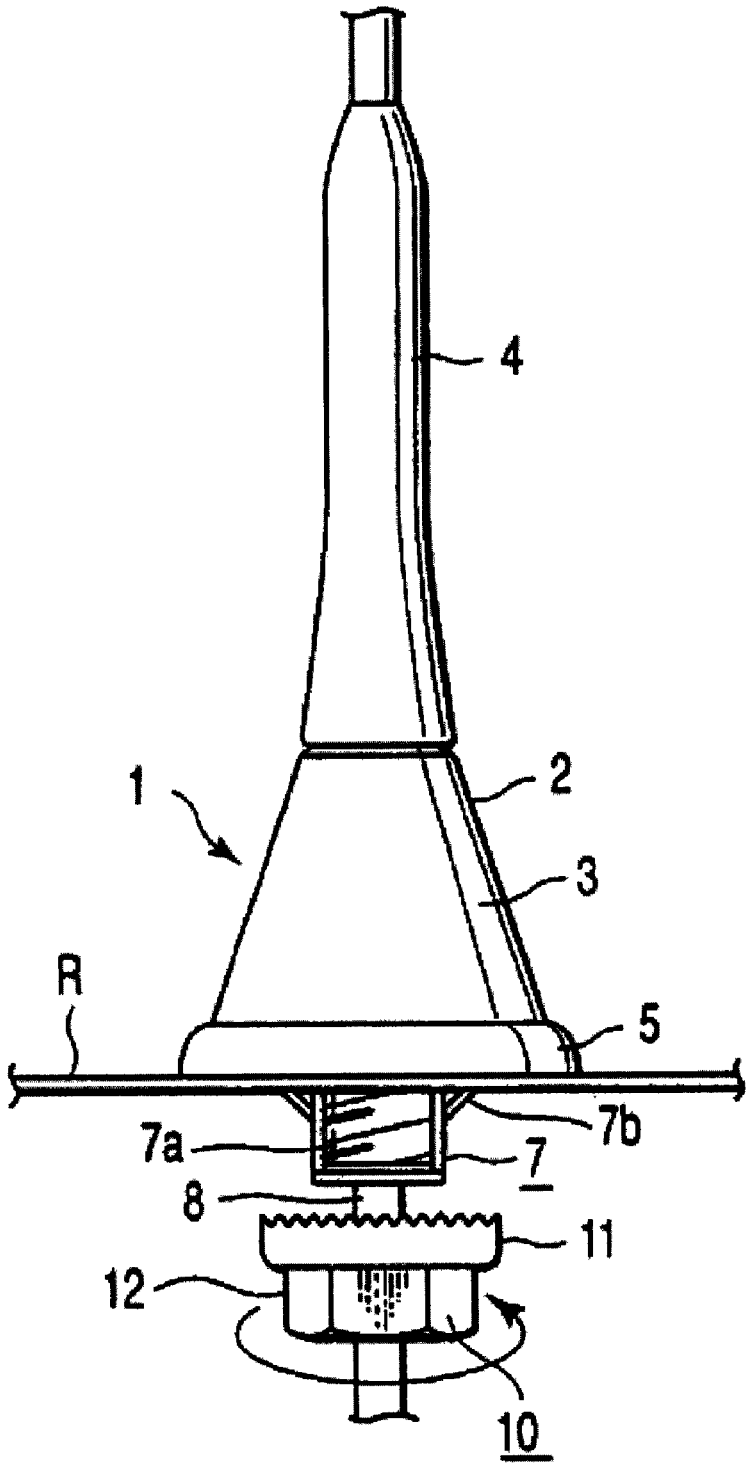
FIG. 15 PRIOR ART
FIG. 15 is an enlarged side view showing essential portions of the antenna device for use in an automobile.

FIG. 11 is a longitudinal cross section showing an antenna device 220 according to a second embodiment of the present invention in an exploded manner; FIG. 12 is a plan view when the antenna device is seen in the direction indicated by the arrow in double dot and chain line α shown in FIG. 11; and FIG. 13 is a plan view when the antenna device is seen in the direction indicated by the arrow in double dot and chain line β shown in FIG. 11. C in these figures indicates a tightening direction in which a screw is mounted by tightening a nut 302 described later.

The antenna device 220 has an antenna main body 230 and a fixing member 300. The antenna main body 230 comprises an antenna cover 231 and an AM/FM antenna element 232 mounted on the antenna cover 231.

A base 240 is mounted at the inside of the antenna cover 231 as shown in FIG. 11. A patch antenna 241 and a substrate 242 are provided at an upper face side of the base 240. In addition, a cylinder body 243 is provided at a lower face side of the case 240, and a male screw 244 is formed on its outer periphery face. A cutout 243*a* is formed on the cylinder body 243. Further, a first connector 250 is mounted on a lower face side of the substrate 242.

The first connector 250 comprises a cylinder shaped connector main body 251, and a temporary lock collar 252 engaged with an outer periphery wall of the connector main body 251. The temporary lock collar 252 comprises an engagement claw 252*a* protruding to the outside from the cutout 243*a* provided at the cylinder body 243. Three female connectors 253 to 255 are formed at the inside of the connector main body 251. An engagement claw 252*a* is formed so as to slacken in a vertical direction shown in FIG. 11, and is formed such that its distal end engages with a peripheral edge of the vehicle inside (lower face in FIG. 11) of the antenna mount hole H of the roof panel R.

The fixing member 300 comprises a cylinder shaped cover body (ground member) 301, a nut 302 mounted to be rotatable with respect to the cover body 301, and a second connector 310 provided in the cover body 301. Cables 311 to 313 are connected to the second connector 310, and these cables each are connected to the male connectors 314 to 316, respectively. In addition, these male connectors 314 to 316 are connected to the female connectors 253 to 255.

A cutout is provided at the cover body 301 along the axial center line direction C, and is configured such that the cables 311 to 313 can be drawn. A claw 301*a* grounded to be compressed against the roof panel R is provided on an upper end face of the cover main body 301. In addition, a female screw 303 helically fitted to the above-described male screw 244 is formed on an inner wall face of the nut 302. Further, a wave washer (elastic body) 304 for biasing the second connector 310 from the side of the cover body 301 to the side of the roof panel R is disposed at an inner face side of the cover body 301 to bias the second connector 310 to the upper side shown in FIG. 1.

The thus configured antenna device 220 may be assembled as follows. As in the first embodiment, the antenna main body 230 and the fixing member 300 are assembled in advance. The subsequent assembling process is roughly divided into three steps. A first step is a step of temporarily locking the first connector 250. A second step is a step of temporarily locking the second connector 310 without establishing an electrical connection. A third step is a step of tightening the nut 302 to establish an electrical connection. Each of these three steps will be described below.

In the first step, the base 240 is positioned at the periphery of the antenna mount hole H on the roof panel R. Next, the first connector 250 is inserted into the antenna mount hole H. At this time, the engagement claw 252*a* is bent inwardly by an edge part of the antenna mount hole H before passing through the antenna mount hole H, and then, passes through the mount hole H. Then, this engagement claw returns to its original shape as illustrated, and protrudes from the antenna mount hole H. Thus, the engagement claw 252*a* engages with a back face of the roof panel R, and the first connector 250 is temporarily locked on the roof panel R.

In the second step, the male connectors 314 to 316 of the second connector 310 are inserted into the female connectors 253 to 255. Mechanical engagement and temporary lock are achieved at a time point when the male connectors 314 to 316 are inserted into the female connectors 253 to 255 to a predetermined depth. At this time, an electrical connection is not achieved and is not desired because full compression between the antenna device 220 and roof panel R has not been established, a seal between the antenna device 220 and roof panel R has not been established and grounding of the antenna device 220 and roof panel R has not been established.

To electrically, test if the antenna device 220 has an electrical connection, the third step is performed. In the third step, the female screw section 303 reaches the male screw 244 when the nut 302 is tightened, and then, the female screw section is helically fitted and tightened. Tightening of the nut 302 is stopped at a time point when the nut 302 compresses the cover body 301 against the roof panel R with a proper force. The claw 301*a* of the cover body 301 is compressed against and cut into the roof panel R, whereby grounding is provided. The electrical connections are achieved at this time between connectors 314 to 316 and connectors 253 to 255.

As described above, according to the antenna device 220 of the present embodiment, a first temporary lock is carried out by inserting the first connector 250 into the antenna mount hole H (first step). A second temporary lock is carried out by inserting the second connector 310 into the first connector 250 without an electrical connection (second step). Lastly, fixing and grounding are provided by tightening the nut 302 (third step). Accordingly, the antenna device 220 can be mounted on the roof panel R by simplified work, and it becomes possible to reliably provide an electrical test of the antenna device 220 to establish if an electrical connection is established and thus establishing that the antenna device 220 has full compression, a tight seal, and grounding to the roof panel R.

The present invention is not limited to the above-described embodiments. For example, while the embodiments have explained connection in three sets of male connectors and female connectors, one or two sets of male connectors and female connectors may be used for actually make connections. In addition, the number of sets for making connections between the male connectors and the female connectors is not limited to three. Further, if a connection is made for use in frequency bandwidth, such a connection is not limited to the above-described connections. Of course, various modifications can occur with departing from the spirit of the invention.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed:

1. An antenna device comprising:

an antenna main body connectable to a first face side of a plate having a mount hole provided therein, the antenna main body including an antenna element, a first connector electrically connected to the antenna element, a first screw section passing through the mount hole, and an engagement section inserted into the mount hole;

a fixing member disposed on a second face side of the plate configurable to removable secured the antenna main body to the plate having a feeder line provided to make connection with the antenna element, a second connector having a male connector removably received by a female connector of the first connector and a second screw section securable to the first screw section to join the antenna main body, the fixing member, and the plate adjacent each other; and a bolt received within a cylinder body for assembling the antenna main body and fixing member;

wherein a mechanical engagement and a temporary lock are achieved when the male connector has been inserted a predetermined distance in the female connector and electrical connection between the male and female connectors is not achieved, and fastening of the bolt joins the first and second screw sections to allow an electrical connection between the male and female connectors.

2. The antenna device of claim 1 wherein mounting the bolt engages the male and female connectors to initiate the electrical connection between the male and female connectors while compressing the antenna base to the fixing member.

3. The antenna device of claim 1 wherein mounting the bolt engages the male and female connectors to initiate the electrical connection between the male and female connectors and creates a seal around the antenna mount hole.

4. The antenna device of claim 1 wherein mounting the bolt engages the male and female connectors to initiate the electrical connection between the male and female connectors and creates a solid ground path for the antenna base to the fixing member.

5. The antenna device of claim 1 wherein the tightening of the bolt is stopped when a washer is compressed against the body such that a protrusion section of the cover body cuts into the roof panel to ground the device.

6. An antenna device of claim 1 wherein the fixing member comprises a grounding member made of an electrically conductive material which abuts against the roof of the vehicle due to tightening of the second screw section.

7. An antenna device adapted to be mounted on a roof of a vehicle comprising:

an antenna main body connectable to a first face side of a plate having a mount hole provided therein, the antenna main body including an antenna element, a first connector electrically connected to the antenna element, a first screw section passing through the mount hole, and an engagement section inserted into the mount hole;

a fixing member disposed on a second face side of the plate configurable to removable secured the antenna main body to the plate having a feeder line provided to make connection with the antenna element, a second connector having a male connector removably received by a female connector of the first connector and a second screw section securable to the first screw section to join the antenna main body, the fixing member, and the plate adjacent each other; and a bolt received within a cylinder body and mounting hole in the vehicle roof for securing the antenna device to the vehicle roof wherein a mechanical engagement and a temporary lock are achieved when the male connector has been inserted a predetermined distance in the female connector and electrical connection between the male and female connectors is not achieved, and fastening of the bolt joins the first and second screw sections to allow an electrical connection between the male and female connectors.

8. The antenna device of claim 7 wherein mounting the bolt engages the male and female connectors to initiate the electrical connection between the male and female connectors while compressing the antenna base to the fixing member.

9. The antenna device of claim 7 wherein mounting the bolt engages the male and female connectors to initiate the electrical connection between the male and female connectors and creates a seal around the antenna mount hole.

10. The antenna device of claim 7 wherein mounting the bolt engages the male and female connectors to initiate the electrical connection between the male and female connectors and creates a solid ground path for the antenna base to the fixing member.

11. An antenna device according to claim 7 wherein the fixing member comprises a grounding member made of an electrically conductive material which abuts against the roof of the vehicle due to tightening of the second screw section.

12. An antenna device according to claim 11 wherein the fixing member further comprises an elastic body provided between the second connector and the grounding member.

13. An antenna device according to claim 11 wherein the fixing member comprises a restricting section which restricts a movement quantity in the tightening direction of the grounding member of the second connector in a predetermined range.

* * * * *